US008052021B2

(12) United States Patent
Wu

(10) Patent No.: US 8,052,021 B2
(45) Date of Patent: Nov. 8, 2011

(54) BRAKING MECHANISM FOR EMPTY NAIL CARTRIDGE OF NAIL GUN

(75) Inventor: I-Tsung Wu, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 165 days.

(21) Appl. No.: 12/686,475

(22) Filed: Jan. 13, 2010

(65) Prior Publication Data

US 2011/0168753 A1 Jul. 14, 2011

(51) Int. Cl.

| | |
|---|---|
| ***B25C 5/02*** | (2006.01) |
| ***B25C 5/06*** | (2006.01) |
| ***B21J 15/28*** | (2006.01) |
| ***B27F 7/17*** | (2006.01) |

(52) U.S. Cl. ..... 227/120; 227/119; 227/8

(58) Field of Classification Search ..... 227/120–128, 227/8, 142; 173/211

See application file for complete search history.

(56) References Cited

U.S. PATENT DOCUMENTS

| | | | | |
|---|---|---|---|---|
| 7,086,573 | B1 * | 8/2006 | Wen | 227/8 |
| 7,150,385 | B1 * | 12/2006 | Wen | 227/8 |
| 7,182,236 | B1 * | 2/2007 | Wen | 227/8 |
| 7,413,103 | B1 * | 8/2008 | Ho et al. | 227/8 |
| 2008/0164295 | A1 * | 7/2008 | Wu et al. | 227/8 |
| 2009/0127310 | A1 * | 5/2009 | Yu | 227/8 |
| 2010/0127035 | A1 * | 5/2010 | Wu | 227/125 |
| 2011/0084111 | A1 * | 4/2011 | Liang | 227/125 |

FOREIGN PATENT DOCUMENTS

| | | |
|---|---|---|
| TW | 321044 | 11/1997 |
| TW | M269156 | 7/2005 |
| TW | I283625 | 7/2007 |

* cited by examiner

*Primary Examiner* — Rinaldi Rada
*Assistant Examiner* — Robert Long
(74) *Attorney, Agent, or Firm* — Chun-Ming Shih

(57) ABSTRACT

A braking mechanism for empty nail cartridge of a nail gun includes a guiding plate, a cover plate, a punch rod, a securing slide rod and a nail cartridge. A nail hole and an end hole are defined in the guiding plate having a connecting groove. A nail pusher and a pushing arm are arranged in the nail cartridge to provide resilient force along a nail firing direction. The pushing arm is pivotably placed on the nail pusher adjacent the brake portion for affording the resilient force. The pushing arm allows the brake portion of the nail pusher to go through the end hole and move into the end hole to block the stopper of the securing sliding rod when the nails are used up. The pushing arm moves into the connecting groove to improve the yield rate of the brake of the empty nail cartridge of the nail gun.

4 Claims, 5 Drawing Sheets

BRAKING MECHANISM FOR EMPTY NAIL CARTRIDGE OF NAIL GUN

BACKGROUND

The present invention relates to braking mechanisms for empty nail cartridge of nail guns and also relates to nail pushers which are slidablely placed in the nail cartridge, and particularly to a pushing arm pivotablely disposed on the nail pusher to punch a nail and brake a securing slide rod.

Braking mechanisms for empty nail cartridge of nail guns, also called punching-stop mechanisms for empty nail cartridge, are used for automatically detecting an empty state of the nail cartridge and the punch hole when the nail cartridge and punch hole runs out of nails. At the same time, the trigger can not be pulled and can not be driven to hit nail, so as to remind the user to reload the nails.

A conventional braking mechanism for empty nail cartridge, as disclosed in TW patent No.321044, utilizes a fixed braking unit extending from a lateral of a nail pusher of a nail cartridge. The nail pusher has a pushing claw for pushing aligned nails in sequence. After the last nail in the nail cartridge is hit, the nail pusher may travel a distance about a thickness of the nail towards the punch hole to stop the movement of the securing slide rod, so that the nail gun can be braked to hit nail and therefore remind the user to reload the nail cartridge. The conventional nail gun employs the nail having thickness about 0.6-1.2 mm. After the last nail in the nail cartridge is hit, the nail pusher may only travel 0.6-1.2 mm towards the punch hole to restrict the securing slide rod. So the securing slide rod may lack blocking area from the nail pusher. If the user unaware that the nails are used up, and pushes the securing slide rod in force, the securing slide hole may break away from the braking unit and affect the yield rate of the brake of the empty nail cartridge.

Further, a braking unit for empty nail cartridge to stop a securing slide rod is disclosed in TW patent No.I283625. The braking unit is slideably disposed on a nail pusher towards a punch hole by resilient thrust force. The braking unit has an ear at a lateral side thereof to push the nail. The nail pusher and the ear can push the nails into the punch hole by sequence. When the last nail in the nail cartridge is hit, the ear can move into the punch hole to restrict movement of the securing slide rod, so that the nail gun can be braked to hit nail. However, the blocking area of the braking unit is also inadequate. When the ear is resiliently moved into the punch hole, and if the nail gun is abnormally operated, the punch rod may move into the punch hole, therefore the punch rod may interfere the ear to move out of the punch hole.

Nowadays, some modified braking methods for empty nail cartridge of the nail guns are disclosed, such as in TW patent No. M269156. A poke member is disposed on a nail pusher of a nail gun. The nail pusher also has a pushing claw for pushing aligned nails in sequence. A slot is defined at a lateral side of the nail pusher. A braking member is rotatably placed in the slot. The braking member can be poked by the poke member. After the last nail in punch hole is hit, the nail pusher and the poke member may together move towards the punch hole travel about the thickness of one nail. The braking member is obliquely rotated out of the nail cartridge pushed by the poke member and placed on movement path of the securing slide rod of the nail gun. The securing slide rod is therefore blocked by the braking member and nail gun is braked to hit nail, so as to remind the user to reload the nails. However, when the braking member is rotated out of the nail cartridge, the securing slide rod can only abut on the cross-sectional area of the braking member out of the nail cartridge. The braking member may be forced by the securing slide rod along oblique direction. The braking member may be easily pushed by the oblique force to move to positions out of the braking position to weaken the stability of the securing slide rod and affect the yield rate of the brake of the empty nail cartridge. Therefore, above drawbacks need to be improved.

BRIEF SUMMARY

To overcome above problems, a control device of a pneumatic nail gun with a control valve is provided for selectively controlling the nail hitting in light of the different work parts.

For this purpose, a braking mechanism for empty nail cartridge of a nail gun includes a guiding plate, a cover plate, a punch rod, a securing slide rod and a nail cartridge. The cover plate is coupled to the guiding plate. A punch channel is defined between a contacting surface of the guiding plate and the cover plate. A nail hole and an end hole are defined in the guiding plate. A connecting hole is defined in the guiding plate communicating with the nail hole and the end hole. The nail hole and the connecting hole communicate with the punching channel respectively. A connecting groove is defined in the cover plate to communicate with the connecting hole and the punch channel. The punch rod is slidably placed in the punch channel to hit nails driven by the nail gun. The securing slide rod is slidably placed on a lateral side of the guiding plate. A stopper is formed on a lateral distal end of the securing slide rod corresponding to the end hole. A nail cartridge is arranged at a lateral side of the guiding plate. The nail cartridge is configured for receiving the nails. A nail pusher and a pushing arm are arranged in the nail cartridge to provide resilient force along a nail firing direction. A brake portion is formed on the nail pusher facing to the end hole. An oblique surface is formed on a lateral distal end of the pushing arm. The pushing arm is pivotably placed on the nail pusher adjacent to the brake portion for affording the resilient force. The pushing arm is opposite to the nail hole. The pushing arm pushes the nails into the punch channel in sequence and allows the brake portion of the nail pusher to go through the end hole and move into the end hole to block the stopper of the securing sliding rod when the nails are used up. The pushing arm moves into the connecting groove via the connecting hole, so that the oblique surface moves over the punch channel and reaches the connecting groove, when the punch rod in the punch channel blocks the pushing arm to move back to an original position. The punch rod pushed by the oblique surface swings to an original position to prevent from being interfered by the punch rod.

Therefore, the embodiments may utilize the pushing arm to push the nails into the punch channel to be hit in sequence via the nail hole, and utilize the pushing arm to detect if exist nail in the punch channel. The connecting groove can receive the pushing arm when the pushing arm is released by removal of the last nail. The pushing arm can move over the punch channel, so that the nail pusher can move to block the securing slide rod at a larger distance relative to the thickness of the one nail. Therefore, the present invention may enhance the blocking surface of the securing slide rod to improve the stability of movement of the securing slide rod and improve the yield rate of the brake of the empty nail cartridge of the nail gun. Further, to overcome the interference between the pushing arm and the punch rod, the pushing arm may get rid of the interference from the punch rod by resiliently swinging to the original position, when the nail gun is abnormally operated. The pushing arm moves over the punch channel may be embodied.

Further, the invention further includes the following features. An end groove is defined in the cover plate communicating with the end hole. The end groove opposite to the end hole. The stopper is embedded into the end groove. When the nails are used up, the brake portion of the nail pusher moves into the end groove via the end hole to block the stopper. The end groove communicates with the connecting groove. The oblique surface faces opposite to nails firing direction in the nail cartridge.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
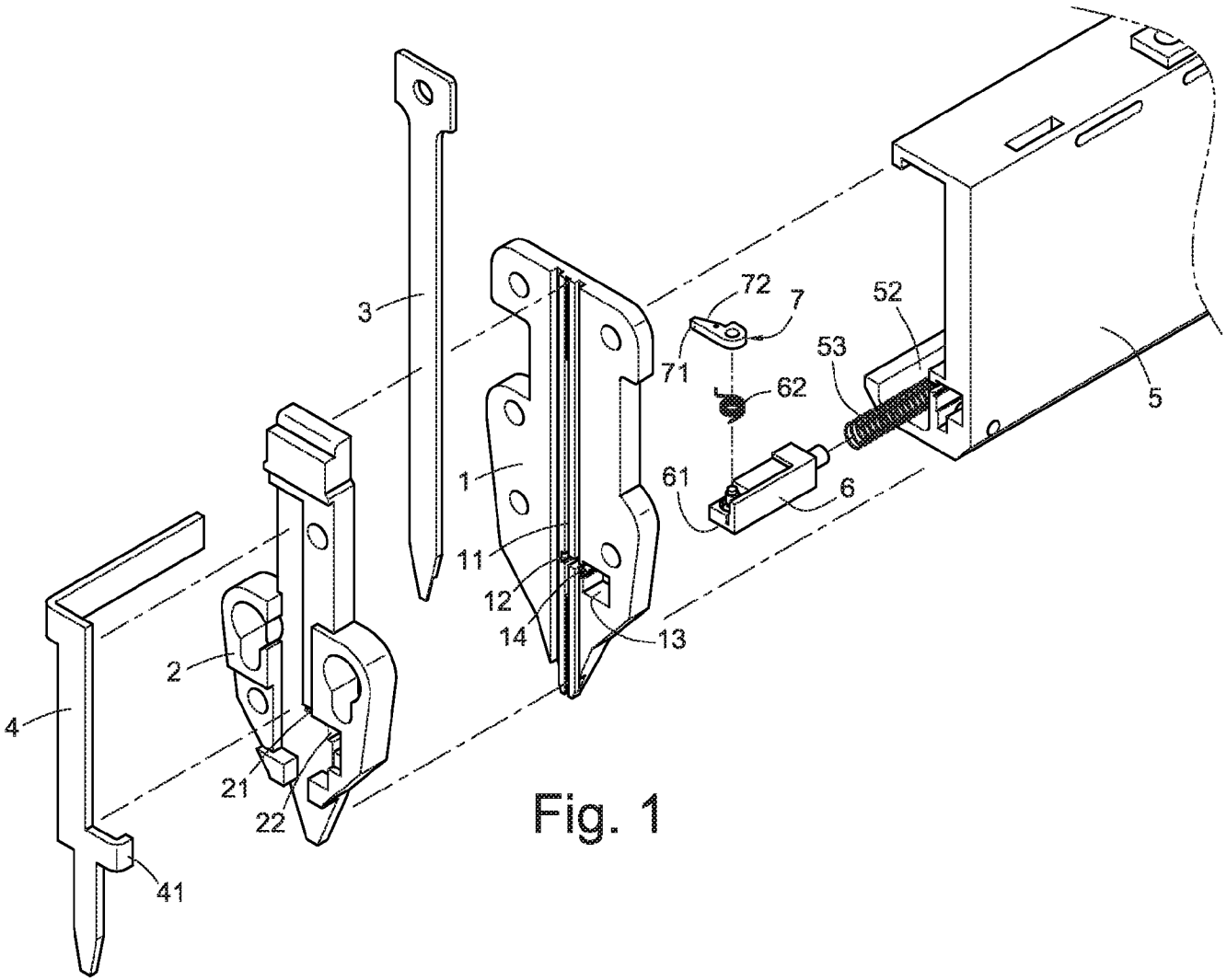
FIG. 1 is an isometric, exploded view according to a preferred embodiment of the invention.

Referring to FIG. 1, an exploded view according to a preferred embodiment of the invention. Also referring to FIG. 2 and FIG. 3, a braking mechanism for an empty nail cartridge of a nail gun, includes a guiding plate 1, a cover plate 2, a punch rod 3, a securing slide rod 4, a nail cartridge 5, a nail pusher 6, and a pushing arm 7. The guiding plate 1 and the cover plate 2 can be coupled together and positions on bottom of a gun body of the nail gun. A punch channel 11 is defined in a contacting surface of the guiding plate 1 and the cover plate 2 (also referring to FIG. 5). The punch channel 11 can also be defined on the surface of the guiding plate 1 according to the present embodiment. The guiding plate 1 defines a nail hole 12, an end hole 13 and connecting hole 14. The nail hole 12 communicates with the end hole 13 via the connecting hole 14. The nail hole 12 and the connecting hole 14 respectively communicate with the punch channel 11. The cover plate 2 defines a connecting groove 21 to communicate with the connecting hole 14 and the punch channel 11, and an end groove 22 to communicate with the end hole 13. The end groove 22 is defined opposite to the end hole 13. The end groove 22 communicates with the connecting groove 21.

Figure 8:
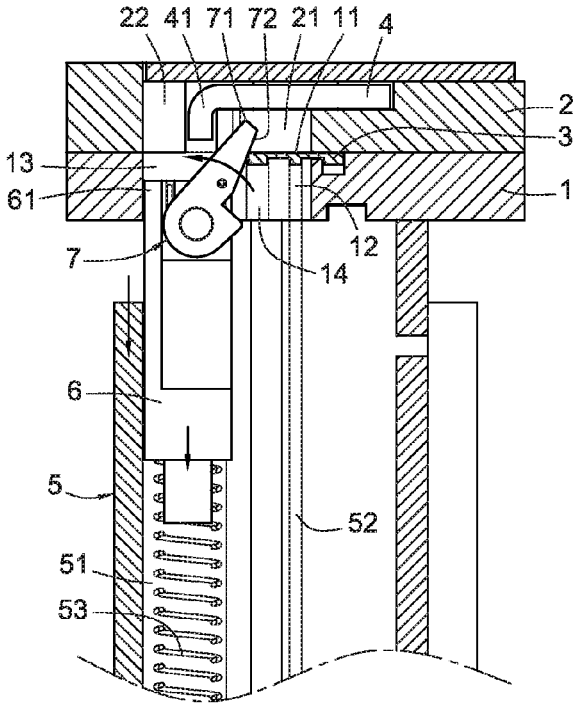
FIG. 8 is similar to FIG. 5, but shows the punch rod pushing the pushing arm along an oblique direction to resiliently swing.

The punch rod 3 (referring to FIG. 1) is placed in the gun body of the nail gun and slideably disposed in the punch channel 11 (referring to FIG. 8). The punch rod 3 can be driven by the nail gun to hit nails. The securing slide rod 4 is slideably disposed at lateral distal ends of guiding plate 1 and the cover plate 2 (referring to FIG. 2). A stopper 41 extends from a lateral distal end of the securing slide rod 4 into the end groove 22 and moves together with the securing slide rod 4 (referring to FIG. 6). The nail cartridge 5 is arranged at a lateral distal end of the guiding plate 1 (referring to FIG. 3). A guiding slot 51 and a guiding groove 52 communicated with the guiding slot 51 are defined inside the nail cartridge 5. The guiding slot 51 communicates with the end hole 13 of the guiding plate 1 and the connecting hole 14. The guiding groove 52 is used to hold the aligned nails 9.

Figure 2:
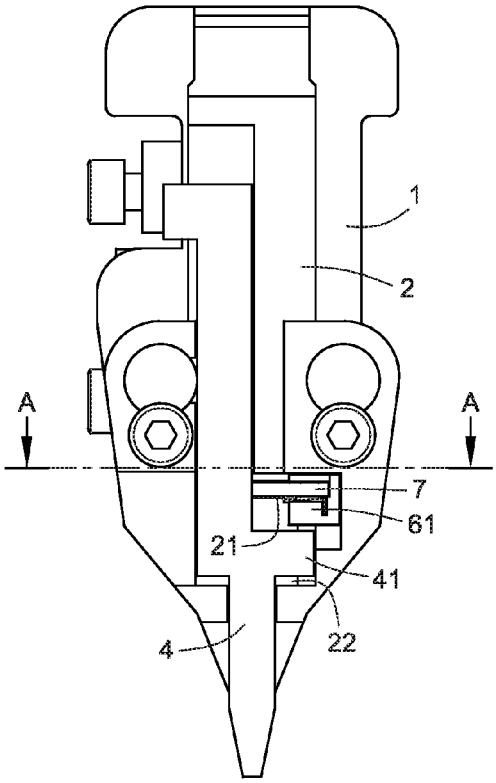
FIG. 2 is an assembled, schematic view of a guiding plate, a cover plate and punch rod of the nail gun of FIG. 1.
Figure 3:
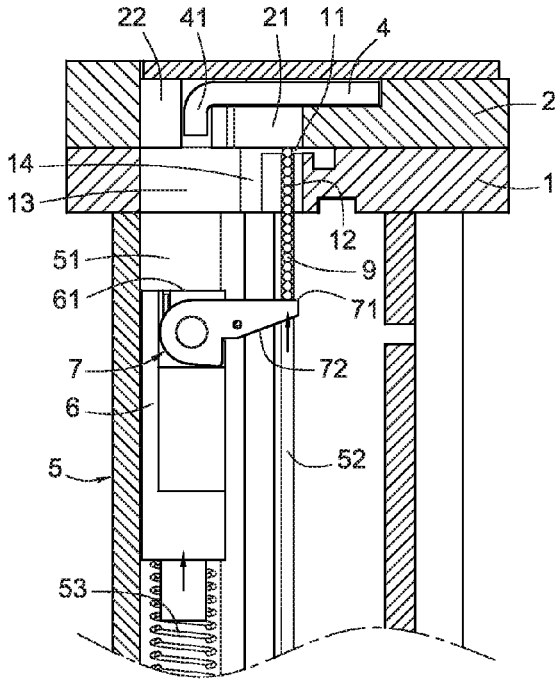
FIG. 3 is a cross-sectional view of FIG. 2 along A-A.

The nail pusher 6 is slideably disposed in the guiding slot 51 of the nail cartridge 5 (referring to FIG. 1-FIG. 3). At least one spring 53 is arranged in the guiding slot 51. The nail pusher 6 can provides resilient force towards the nail hole 12 driven by the at least spring 53. A brake portion 61 is formed on the nail pusher 6 facing to the end hole 13. The pushing arm 7 is pivotably disposed on the nail pusher 6 adjacent the brake portion 61. A coil spring 62 is arranged between the pushing arm 7 and the nail pusher 6. The pushing arm 7 is resiliently attached to the nail pusher 6. One end of pushing arm 7 extends to the guiding groove 52 to form a pushing portion 71 opposite to the nail hole 12. The pushing portion 71 can push the nails 9 into the punch channel 11 to be hit via the nail hole 12 in sequence. An oblique surface 72 is formed on a lateral distal end of the pushing arm 7. The oblique surface 72 is opposite to a direction of firing the nails 9 into the punch channel 11 by the nail cartridge 5.

Based on above components, the braking method for empty nail cartridge of the nail gun may be embodied in the following descriptions.

Figure 4:
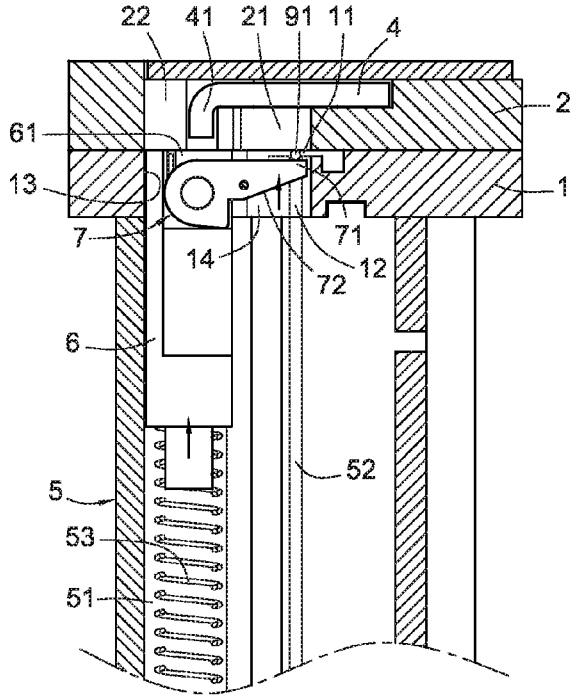
FIG. 4 shows a working state of FIG. 3, the punch rod being blocked by the last nail and the nail pusher staying in the end hole.

When the aligned nails 9 are installed in the nail cartridge 5 and the punch cannel 11 (as shown in FIG. 3). The nail pusher 6 driven by the spring 53 moves along the guiding slot 51 to the end hole 13. The pushing portion 71 of the pushing arm 7 moves together with the nail pusher 6 along the guiding groove 52 to the nail hole 12. The nails 9 in the guiding groove 52 are pushed into the punch channel 11 via the nail hole 12 in sequence by the pushing portion 71. At this time, the stopper 41 of the securing slide rod 4 is not blocked by the brake portion 61 of the nail pusher 6. Thus, in normal operation, the securing slide rod 4 and the stopper 41 may move to hit the nail 9. The nail pusher 6 may gradually move towards the end hole 13 along with decrease of the aligned nails 9 in the cartridge 5, and moves into the end hole 13 (as shown in FIG. 4). The pushing arm 7 may also move into the connecting hole 14 and the nail hole 12.

Figure 5:
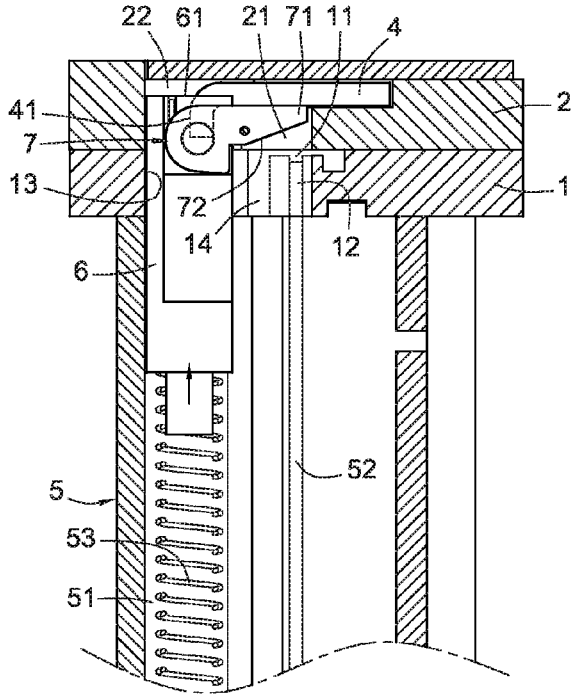
FIG. 5 is similar to FIG. 4, but shows the punch rod moving over a punch channel, and the nail pusher being moved into an end groove and braking the securing slide rod.
Figure 6:
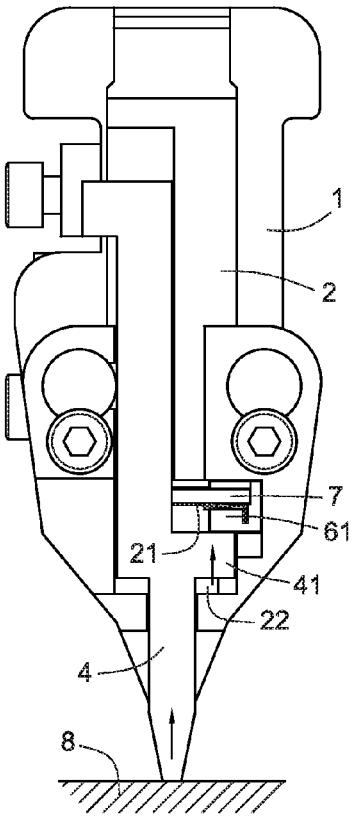
FIG. 6 shows a working state of FIG. 2, a braking portion of the nail pusher blocking a stopper to brake the securing slide rod.

Before the last nail 91 in the punch channel 11 to be hit (as shown in FIG. 4). The nail pusher 6 and the pushing arm 7 can be blocked by the last nail 91 on the pushing portion 71. The nail pusher 6 still stays in the end hole 13. The pushing arm 7 stays in the connecting hole 14 and the nail hole 12. When the last nail 91 in the nail channel 11 is hit out of the nail channel 11 (as shown in FIG. 5), the pushing portion 71 is not blocked by any nails, the nail pusher 6 and the pushing arm 7 respectively move into the end slot 22 and the connecting groove 21. The brake portion 61 moves into the end groove 22 through the end hole 13 and blocks on the passing way of the stopper 41 of the securing slide rod 4, and the oblique surface 72 moves into the connecting groove 21 over the punch channel 11. At this time, if the bottom end of the securing slide rod 4 is knocked or pushed by a surface of a work piece 8 (as shown in FIG. 6), the stopper 41 capable of moving along the axis of the nail is blocked by the brake portion 61, so the securing slide rod 4 can not move upward. The nail gun is braked.

Figure 7:
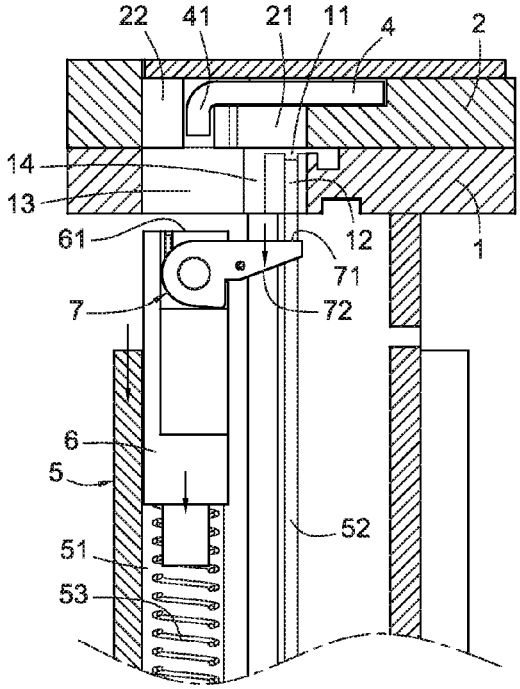
FIG. 7 is similar to FIG. 5, but shows the nail pusher can be pushed back into the nail cartridge.
Figure 9:
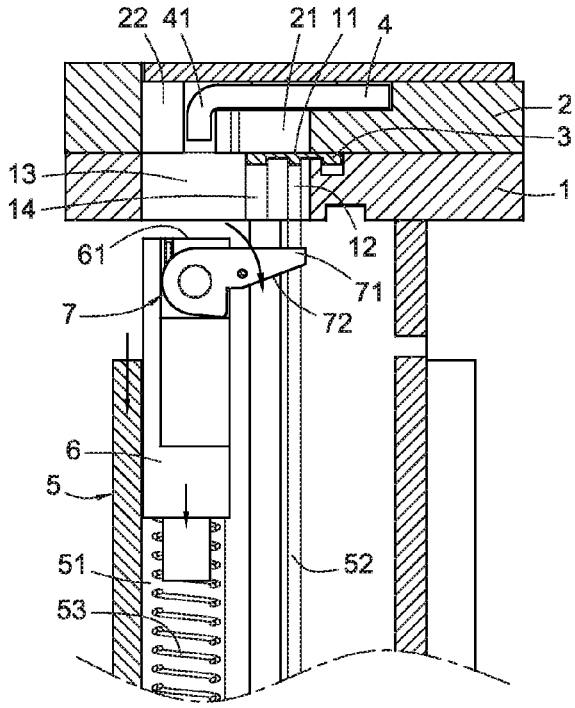
FIG. 9 is similar to FIG. 8, but shows the pushing arm can resiliently swing back to an original position.

When the nail gun needs to reload the nails 9, the nail cartridge 5 can be directly opened. The nail pusher 6 together with nail cartridge 5 move towards the opening direction (as shown in FIG. 7). The nail pusher 6 in the end slot 22 can directly move into the guiding slot 51 of the nail cartridge 5 through the end hole 13, and the pushing arm 7 in the connecting groove 21 can directly move into the guiding groove 52 of the nail cartridge 5 through the punch channel 11, the nail hole 12 and the connecting hole 14. Then, the nail cartridge 5 can be reloaded. If the punch rod 3 still stays in the punch channel 11 (as shown in FIG. 8), the pushing arm 7 moving together with the nail cartridge 5 can push the punch rod 3 by the oblique surface 72. The punch rod 3 pushes the pushing arm 7 along the oblique surface 72 to swing the pushing arm 7, so that the pushing arm 7 can move over the punch rod 3 to eliminate interference of the punch rod 3. The pushing arm 7 can also elastically swing back to the original position (as shown in FIG. 9).

According to the above description, embodiments are definitely and fully disclosed, especially utilize the pushing arm 7 to push the nails 9 into the punch channel 11 to be hit via the nail hole 12, and utilize the pushing arm 11 to detect if exist nail in the punch channel 11. The connecting groove 21 can receive the pushing arm 7 when the pushing arm 7 is released by removal of the last nail 91. The pushing arm 7 can moves over the punch channel 11, so that the nail pusher 6 can move to block the securing slide rod 4 at a larger distance relative to the thickness the one nail 9. Therefore, the present invention may enhance the blocking surface of the securing slide rod 4 to improve the stability of movement of the securing slide rod 4 and improve the yield rate of the brake of the empty nail cartridge of the nail gun. Further, to overcome the interference between the pushing arm 7 and the punch rod 3, the pushing arm 7 may get rid of the interference from the punch rod 3 by resiliently swinging to the original position, when the nail gun is abnormally operated. The pushing arm 7 moves over the punch channel 11 may be embodied.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A braking mechanism for empty nail cartridge of a nail gun comprising:

a guiding plate and a cover plate coupled to the guiding plate, a punch channel defined between a contacting surface of the guiding plate and the cover plate, a nail hole and an end hole defined in the guiding plate, a connecting hole defined in the guiding plate communicating with the nail hole and the end hole, the nail hole and the connecting hole communicating with the punching channel respectively, a connecting groove defined in the cover plate to communicate with the connecting hole and the punch channel;

a punch rod slidably placed in the punch channel to hit nails driven by the nail gun;

a securing slide rod, slidably placed on a lateral side of the guiding plate, a stopper formed on a lateral distal end of the securing slide rod corresponding to the end hole;

a nail cartridge, arranged at a lateral side of the guiding plate, configured for receiving the nails, a nail pusher and a pushing arm arranged in the nail cartridge to provide resilient force along a nail filling direction, a brake portion formed on the nail pusher facing to the end hole, an oblique surface formed on a lateral distal end of the pushing arm, the pushing arm being pivotably placed on the nail pusher adjacent to the brake portion for affording the resilient force, and the pushing arm opposite to the nail hole, the pushing arm pushing the nails into the punch channel in sequence and allowing the brake portion of the nail pusher to go through the end hole and move into the end hole to block the stopper of the securing sliding rod when the nails is use up, the pushing arm moving into the connecting groove via the connecting hole, so that the oblique surface moves over the punch channel and reaches the connecting groove, when the punch rod in the punch channel blocks the pushing arm to move back to an original position, the punch rod pushed by the oblique surface swinging to an original position to prevent from being interfered by the punch rod.

2. A braking mechanism as claimed in claim 1, wherein an end groove is defined in the cover plate communicating with the end hole, the end groove opposite to the end hole, the stopper is embedded into the end groove, when the nails are used up, the brake portion of the nail pusher moves into the end groove via the end hole to block the stopper.

3. A braking mechanism as claimed in claim 2, wherein the end groove communicates with the connecting groove.

4. A braking mechanism as claimed in claim 1, wherein the oblique surface faces opposite to nails filling direction in the nail cartridge.

* * * * *